US008387337B2

(12) United States Patent
Hamlin, III

(10) Patent No.: US 8,387,337 B2
(45) Date of Patent: Mar. 5, 2013

(54) SINGLE PIECE MEMBRANE FLASHING AND FASTENING DEVICE AND METHOD

(76) Inventor: Henry Lee Hamlin, III, Macon, GA (US)

( * ) Notice: Subject to any disclaimer, the term of this patent is extended or adjusted under 35 U.S.C. 154(b) by 599 days.

(21) Appl. No.: 12/214,071

(22) Filed: Jun. 16, 2008

(65) Prior Publication Data

US 2009/0000239 A1 Jan. 1, 2009

Related U.S. Application Data

(60) Provisional application No. 60/934,896, filed on Jun. 15, 2007.

(51) Int. Cl.
*E04B 1/00* (2006.01)

(52) U.S. Cl. ..... 52/741.4; 52/748.1; 52/58; 52/300; 52/506.06; 52/512

(58) Field of Classification Search ..... 52/58, 60, 52/302.5, 94, 96, 408, 410, 509, 741.4, 300, 52/409, 506.06, 512, 748.1
See application file for complete search history.

(56) References Cited

U.S. PATENT DOCUMENTS 4,156,993 A * 6/1979 Sorrells, Jr. ..... 52/60
4,520,606 A * 6/1985 Francovitch ..... 52/410
4,598,507 A * 7/1986 Hickman ..... 52/94
4,619,094 A * 10/1986 Yang ..... 52/410
4,780,995 A * 11/1988 Gittins ..... 52/60
4,780,999 A * 11/1988 Webb et al. ..... 52/96
4,800,689 A * 1/1989 Lane ..... 52/60
4,833,853 A * 5/1989 Deibele et al. ..... 52/410
4,912,900 A * 4/1990 Yeamans ..... 52/273
4,932,171 A * 6/1990 Beattie ..... 52/58
5,392,576 A * 2/1995 Yeamans ..... 52/408
5,605,020 A * 2/1997 Chambers ..... 52/58
5,619,827 A * 4/1997 Church ..... 52/60
6,052,956 A * 4/2000 Hoy et al. ..... 52/200
6,665,991 B2 * 12/2003 Hasan ..... 52/410
7,284,933 B2 * 10/2007 Calandra et al. ..... 405/302.1
7,331,145 B2 * 2/2008 Feucht et al. ..... 52/58
7,631,468 B2 * 12/2009 Gong et al. ..... 52/410
7,647,730 B1 * 1/2010 Inzeo et al. ..... 52/60
7,836,658 B2 * 11/2010 Perrot, Jr. ..... 52/741.4
2005/0126099 A1 * 6/2005 Kelly ..... 52/412

* cited by examiner

*Primary Examiner* — Robert Canfield
*Assistant Examiner* — Matthew Gitlin
(74) *Attorney, Agent, or Firm* — Brian D. Bellamy

(57) ABSTRACT

The purpose of this invention is to decrease labor involved in waterproofing via flashing and termination of a pliable membrane roofing system at its perimeters and vertical junctures. As opposed to a standard two piece membrane flashing, the invention provides for a single piece of membrane to be used. The single piece of membrane would be taken from that which has already been installed on the flat portion of the roof. The loose section would be folded and the folded section would be anchored to the roof or vertical junctures. The piece now left loose would be folded over the anchoring device and terminated on the roof or vertical juncture. There are 3 devices disclosed which are intended to serve the purpose of anchoring the folded portion of roof. Elimination of the two piece flashing will greatly decrease the labor involved in roof installation with no loss in roof performance.

5 Claims, 13 Drawing Sheets

Fig. 2A
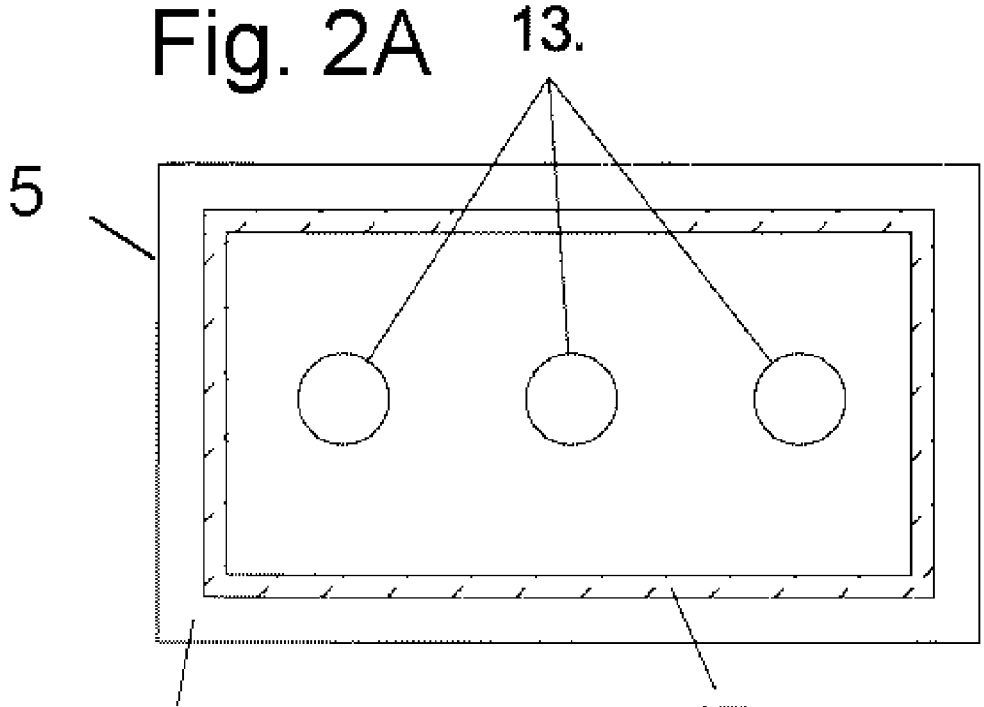
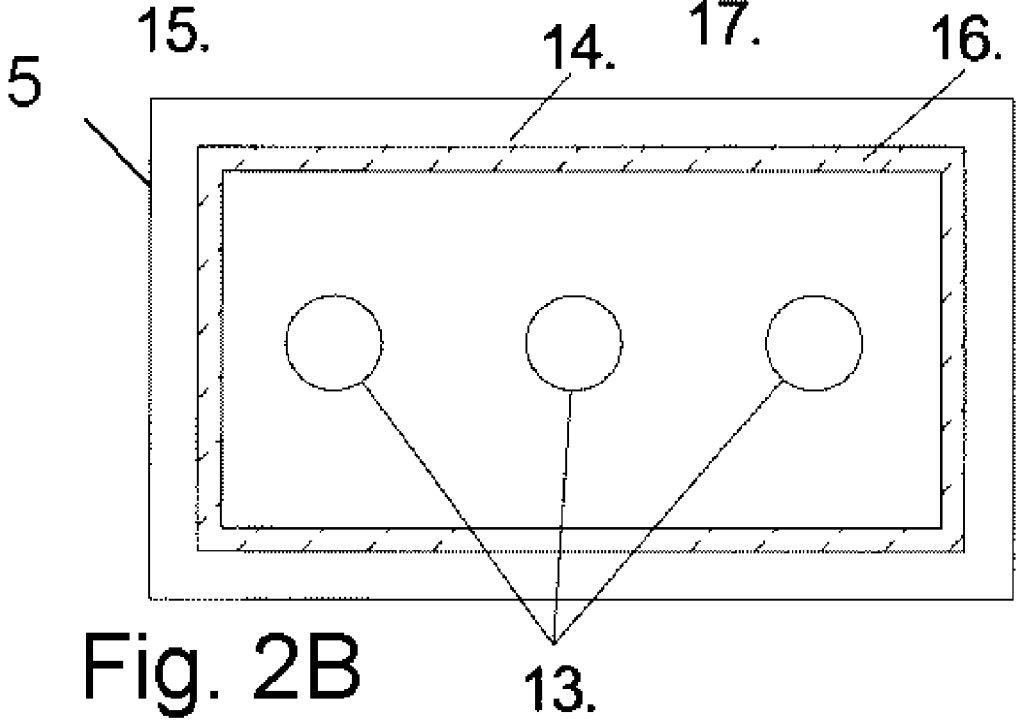
Fig. 2B

Fig. 3A
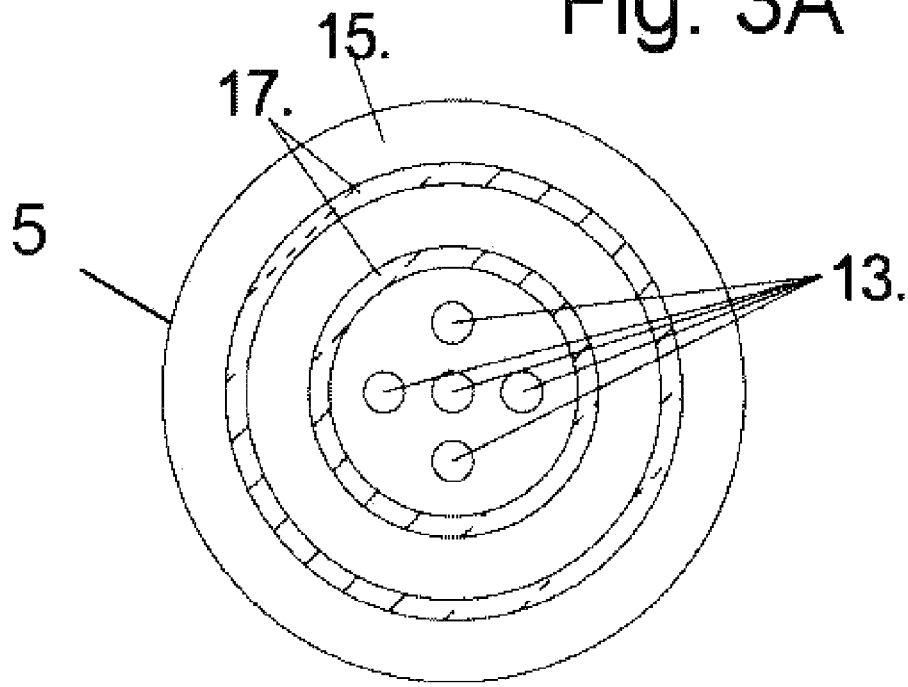
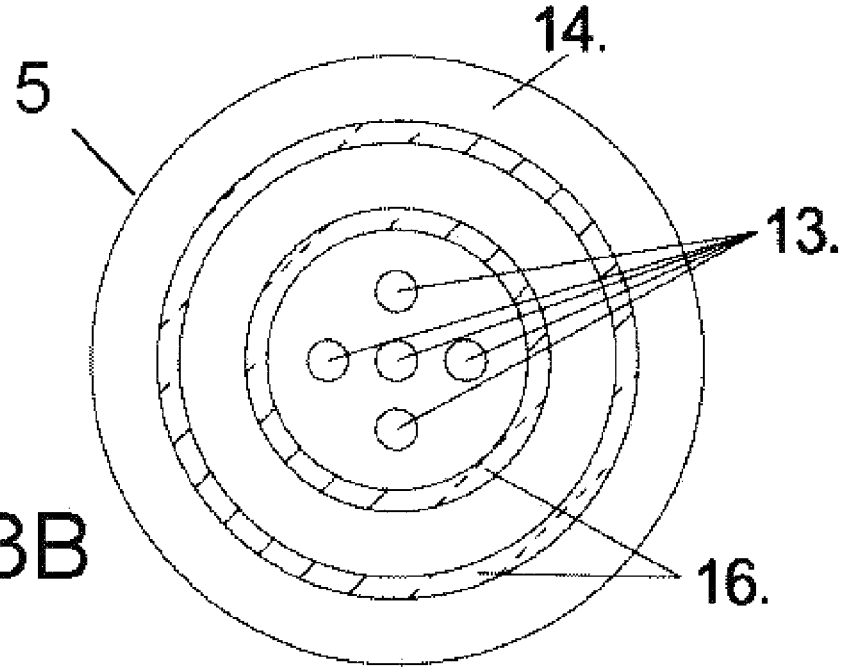
Fig. 3B

Fig. 4A
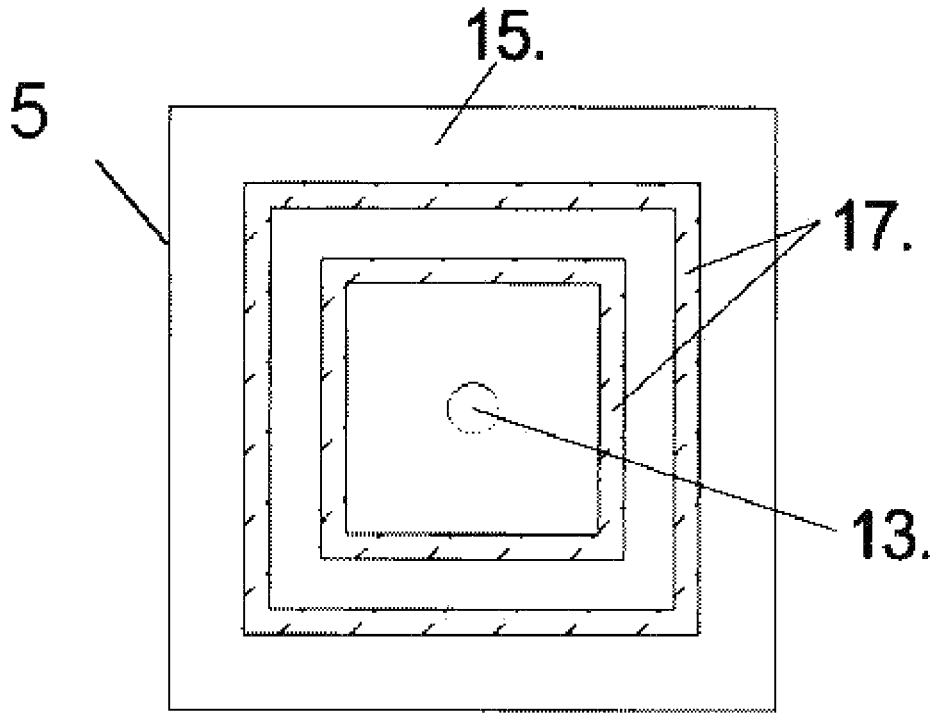
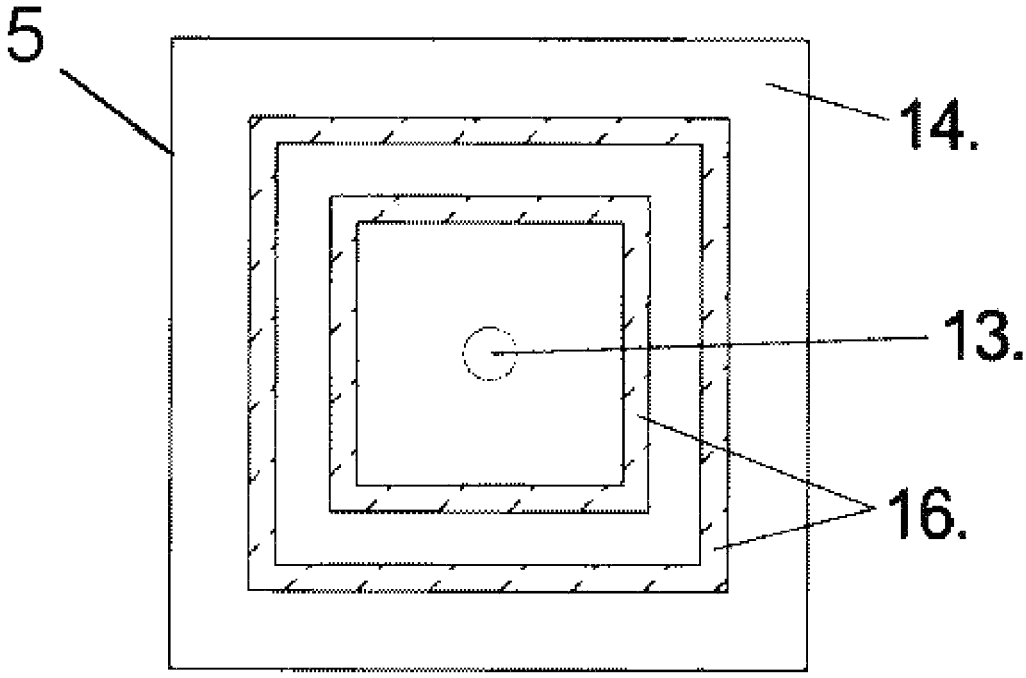
Fig. 4B

SINGLE PIECE MEMBRANE FLASHING AND FASTENING DEVICE AND METHOD

CROSS REFERENCE TO RELATED APPLICATIONS

This invention is based upon and claims the benefit of priority from U.S. Provisional Application Ser. No. 60/934,896 filed the 15 of Jun., 2007.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to the field of flashing the perimeters and penetrations of flat roofing systems whereby a pliable waterproofing membrane is used to cover the roof and then folded in a specified manner in order to protect the fasteners and further waterproof the building.

2. Background

In the field of flat or low-slope roof installation, the use of pliable reinforced membranes to waterproof buildings is becoming ever more popular due to their ease of use and many advantages. However, as with any roofing system, there are difficulties and complications that arise when one considers how to waterproof the perimeter of a building (at any vertical junctures such as a wall or the flat edge of the roof) as well as any projections through and above the roof. The primary difficulty arises due to the seams and vertical junctures, which create a need to terminate the membrane in a completely watertight fashion.

This difficulty of waterproofing membrane terminations in the past has been dealt with by several methods, primarily by use of a two piece membrane flashing system coupled with pre-formed sheet metal parts. Typically, on a flat roof with a parapet wall, the membrane on the horizontal part of the roof is cut at the junction between the wall and the roof. This membrane is then fastened by the same means as the rest of the flat part of the roof. Then, a separate piece of membrane is attached to the wall by means of termination bar (typically a pre-formed piece of sheet metal) and the uppermost junction of the termination bar with the wall is sealed with a bead of watertight sealant. The loose membrane below the location of the termination bar is then folded at the wall-roof junction and adhered (typically by chemical or thermal means) to the first piece of membrane on the horizontal roof, thereby covering and sealing in the fasteners.

Curbs (rectangular projections through a roof) are typically flashed in a very similar manner, requiring more fasteners than on a flat portion of the roof in order to sufficiently waterproof the penetration. There is also a pre-formed corner that is designed to fit over the corners of these penetrations. They are made of the same base material as the membrane used on the roof and are chemically compatible with said membrane. The membrane around the curb has to be fastened in the same manner as the rest of the roofing membrane and then have another separate piece of membrane covering the vertical surfaces of the curb and also covering the fasteners around its perimeter in order to protect and waterproof them.

The difficulty with using two pieces of membrane to flash the roof lies particularly in the increased labor involved. The membrane must first be fastened to the roof itself. Mechanical fasteners are typically placed from six inches to eighteen inches apart, which can amount to a considerable number of fasteners on the perimeter and penetrations of a large building. Chemical adherence (typically a specialized type of glue or tape) can be very time consuming as well. After fastening the membrane to the substrate that is already attached to the roof, a separate piece of membrane must be cut and terminated at one end then also welded to the membrane. This multi-step process requires intensive labor and time. In addition, it can be easy to make an error in this complicated process. Any portion of the membrane that does not create a perfect seal will allow moisture underneath the membrane, potentially leaking and causing damage to the substrate and roof deck.

It is the goal of the system and accompanying devices to simplify the process of installing membrane roofing on flat roofs. To be able to use only a single piece membrane flashing for edges and curbs will not only make the roof installation process simpler and less time consuming but will also decrease the likelihood of water penetrating through to the substrate and, in turn, make a more waterproof roofing system with high versatility and ease of installation. Furthermore, the system attempts to reduce potential water penetration by use of ridges in the devices and compression of the membrane at fastening points. This system will retain a high level of wind uplift resistance and maintain strength at all fastening points.

There have been previous attempts at solving some, but not all, of the above listed problems and difficulties. U.S. Pat. No. 5,619,827 attempted to solve the problem of waterproofing a roof at the edge by use of interlocking sheet metal assemblies that serve to anchor the roof as well as waterproof it. However, this system only works for situations where the roof is entirely horizontal and there is no vertical wall. In addition, it does not appear to make the roofing installation process much simpler than the current methods. This method does make use of a non-penetrative means of anchoring the membrane to the roof, which increases waterproofing capabilities simply in the fact that no hole is made in the roofing membrane. There does appear to be a question of how well the system can anchor the membrane down sufficiently, leaving it open to pulling due to thermal shrinkage and detachment due to high winds.

The most common fastening method for membranes is the stress plate, as described in U.S. Pat. No. 4,787,188. The plate's primary purpose is to clamp the membrane to the roof deck. In its most used form, the stress plate is circular, with a centrally located fastening hole, which accepts a screw or other mechanical fastener. The plate has two sets of concentric ridges. It is placed on top of the membrane and a fastener extends through the plate and to the roof deck. The prongs inhibit motion of the membrane in relation to the plate. However, since the plate is not watertight, it has to be overlapped with a separate portion of membrane, heat or chemically welded to cover the plate and fastener and waterproof them. For the inner (non-perimeter) portion of the roof, this is the most common and efficient method of fastening membrane. However, due to the lack of a seam and the need for more fasteners at the perimeter (as well as at curbs and other penetrations), there is desired a better method of waterproofing a roof and securing it to the building structure.

SUMMARY OF THE INVENTION

The system described herein is based on the idea of using standard fastening means of attaching a roofing membrane to a roof structure in the interior of a flat roof and using the specialized means herein to fasten the membrane at the perimeter of the roof, as well as at the curbs and other penetrations (areas where flashing is required). At the perimeter (either at a wall rising above the level of the roof or at the vertical portion of the building beneath the level of the roof), a longer than normal length of membrane is taken and folded over to form a folded seam. The invention encompasses a series of specialized devices that can be used to anchor the folded seam of roofing membrane to the deck, wall or lower wall, whereby the excess membrane is then folded up and over the fastening device then terminated by standard methods. The primary goal and intent of this invention is to replace the method of flashing vertical junctures with two pieces of membrane and to instead simplify the process by means of a single piece membrane flashing. Methods and devices disclosed herein can be used as part of the total system or can be combined with any number of industry standard methods and devices.

DESCRIPTION OF THE DRAWINGS

FIG. 2A is a top view of an alternate embodiment in a rectangular shape of the first device (5) that is described showing an upper plate. It includes multiple fastening points (13) and a single raised ridge (17) on the upper plate (15) and a single raised ridge (16) on the lower plate (14). The upper plate (15) is designed to fit securely over the lower plate (14) and a fastener would pass through the fastening points (13) in both the upper plate (15) and the lower plate (14).

FIG. 2B is a top view of an alternate embodiment in a rectangular shape of the first device (5) that is described showing a lower plate. It includes multiple fastening points (13) and a single raised ridge (17) on the upper plate (15) and a single raised ridge (16) on the lower plate (14). The upper plate (15) is designed to fit securely over the lower plate (14) and a fastener would pass through the fastening points (13) in both the upper plate (15) and the lower plate (14).

FIG. 3A is a top view of another alternate embodiment in a circular shape of the first device (5) that is described showing an upper plate. It includes multiple fastening points (13) and a duality of raised ridges (17) on the upper plate (15) and a duality of raised ridges (16) on the lower plate (14). The upper plate (15) is designed to fit securely over the lower plate (14) and a fastener would pass through the fastening points (13) in both the upper plate (15) and the lower plate (14).

FIG. 3B is a top view of another alternate embodiment in a circular shape of the first device (5) that is described showing a lower plate. It includes multiple fastening points (13) and a duality of raised ridges (17) on the upper plate (15) and a duality of raised ridges (16) on the lower plate (14). The upper plate (15) is designed to fit securely over the lower plate (14) and a fastener would pass through the fastening points (13) in both the upper plate (15) and the lower plate (14).

FIG. 4A is a top view of another alternate embodiment in a square shape of the first device (5) that is described showing an upper plate. It includes a single fastening point (13) and a duality of raised ridges (17) on the upper plate (15) and a duality of raised ridges (16) on the lower plate (14). The upper plate (15) is designed to fit securely over the lower plate (14) and a fastener would pass through the fastening points (13) in both the upper plate (15) and the lower plate (14).

FIG. 4B is a top view of another alternate embodiment in a square shape of the first device (5) that is described showing a lower plate. It includes a single fastening point (13) and a duality of raised ridges (17) on the upper plate (15) and a duality of raised ridges (16) on the lower plate (14). The upper plate (15) is designed to fit securely over the lower plate (14) and a fastener would pass through the fastening points (13) in both the upper plate (15) and the lower plate (14).

DETAILED DESCRIPTION OF THE INVENTION

Figure 1A:
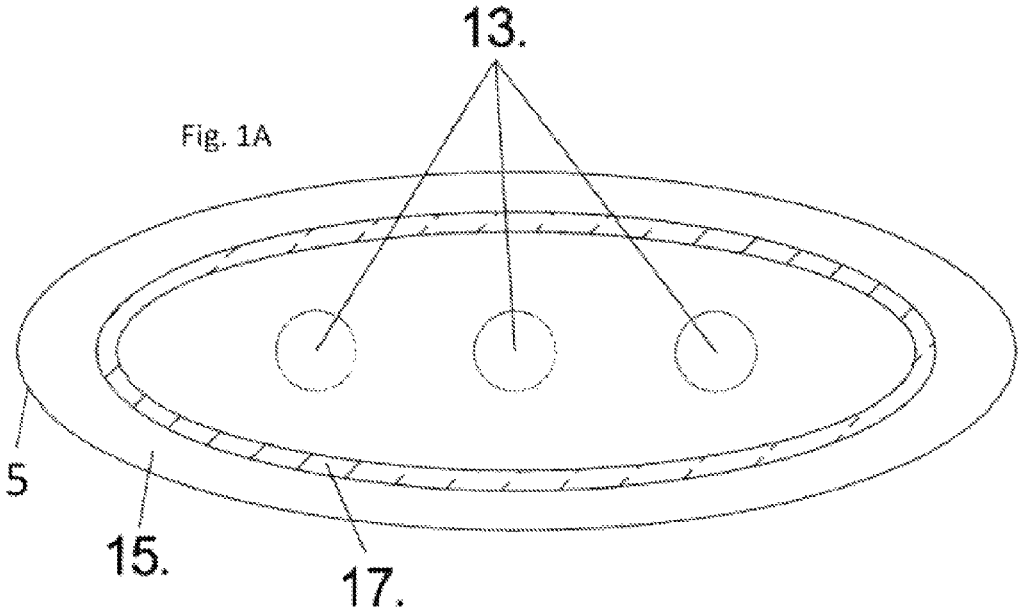
FIG. 1A is a top view of one possible embodiment in an ellipsoidal shape of the first device (5) that is described showing an upper plate. It includes multiple fastening points (13) and a single raised ridge (17) on the upper plate (15) and a single raised ridge (16) on the lower plate (14). The upper plate (15) is designed to fit securely over the lower plate (14) and a fastener would pass through the fastening points (13) in both the upper plate (15) and the lower plate (14).
Figure 1B:
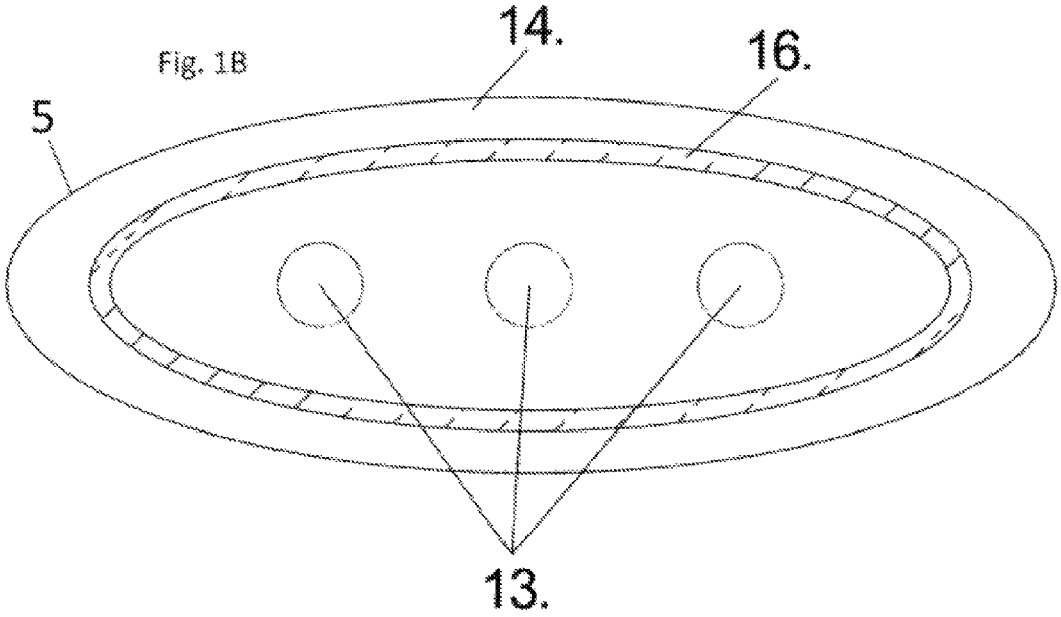
FIG. 1B is a top view of one possible embodiment in an ellipsoidal shape of the first device (5) that is described showing a lower plate. It includes multiple fastening points (13) and a single raised ridge (17) on the upper plate (15) and a single raised ridge (16) on the lower plate (14). The upper plate (15) is designed to fit securely over the lower plate (14) and a fastener would pass through the fastening points (13) in both the upper plate (15) and the lower plate (14).
Figure 5:
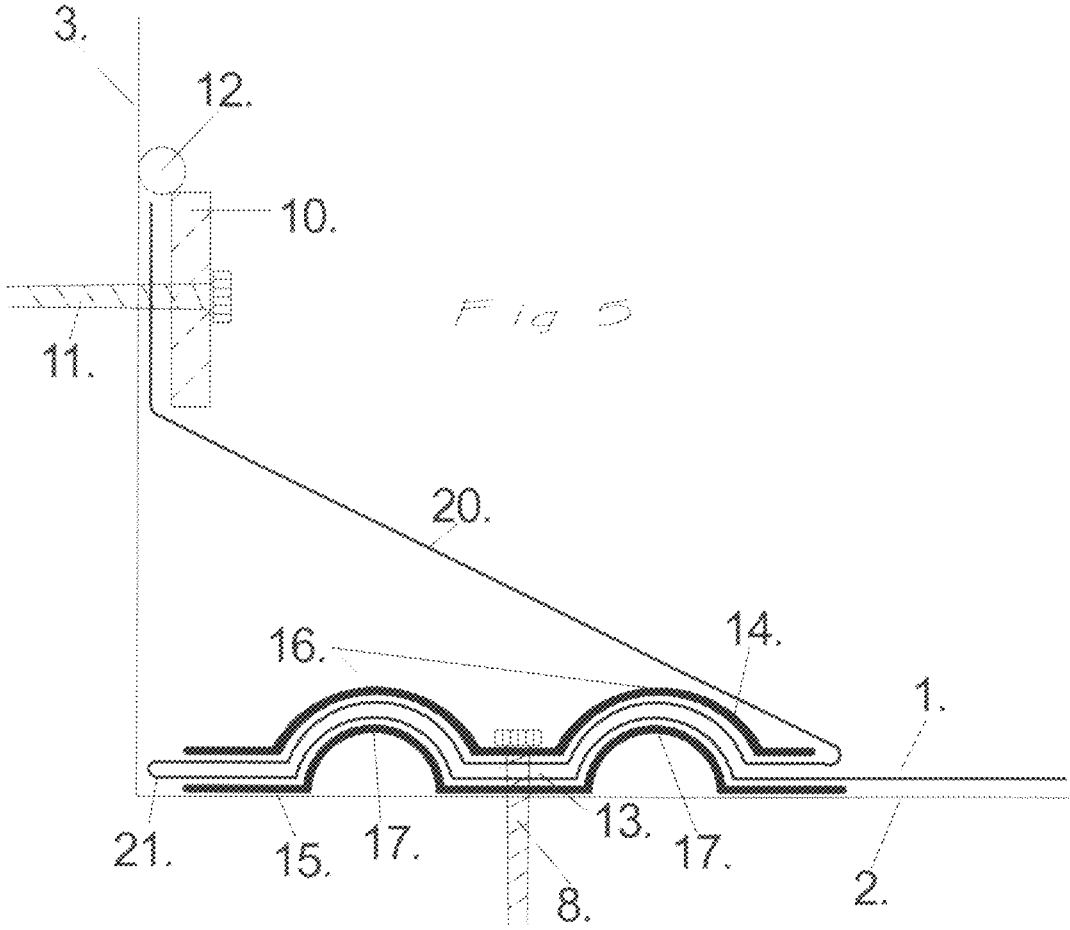
FIG. 5 is a side cutout view of the first device (5) that is described showing the device (5) in use. The device (5) is mounted on the roof substrate (2) with the folded portion of the membrane (21) placed between the upper plate (14) and the lower plate (15) and secured by use of a mechanical fastener (8) passing through the folded portion of the membrane (21) as well as both plates (14 and 15) by use of the fastening points (13). The ridges (16) on the upper plate (14) cooperate with the ridges (17) on the lower plate (15). The excess membrane (20) is folded up and onto the wall (3), whereby it is terminated by use of termination bar (10) fastened with a mechanical fastener (11) and sealant (12) at the upper point of the termination bar (10).
Figure 6:
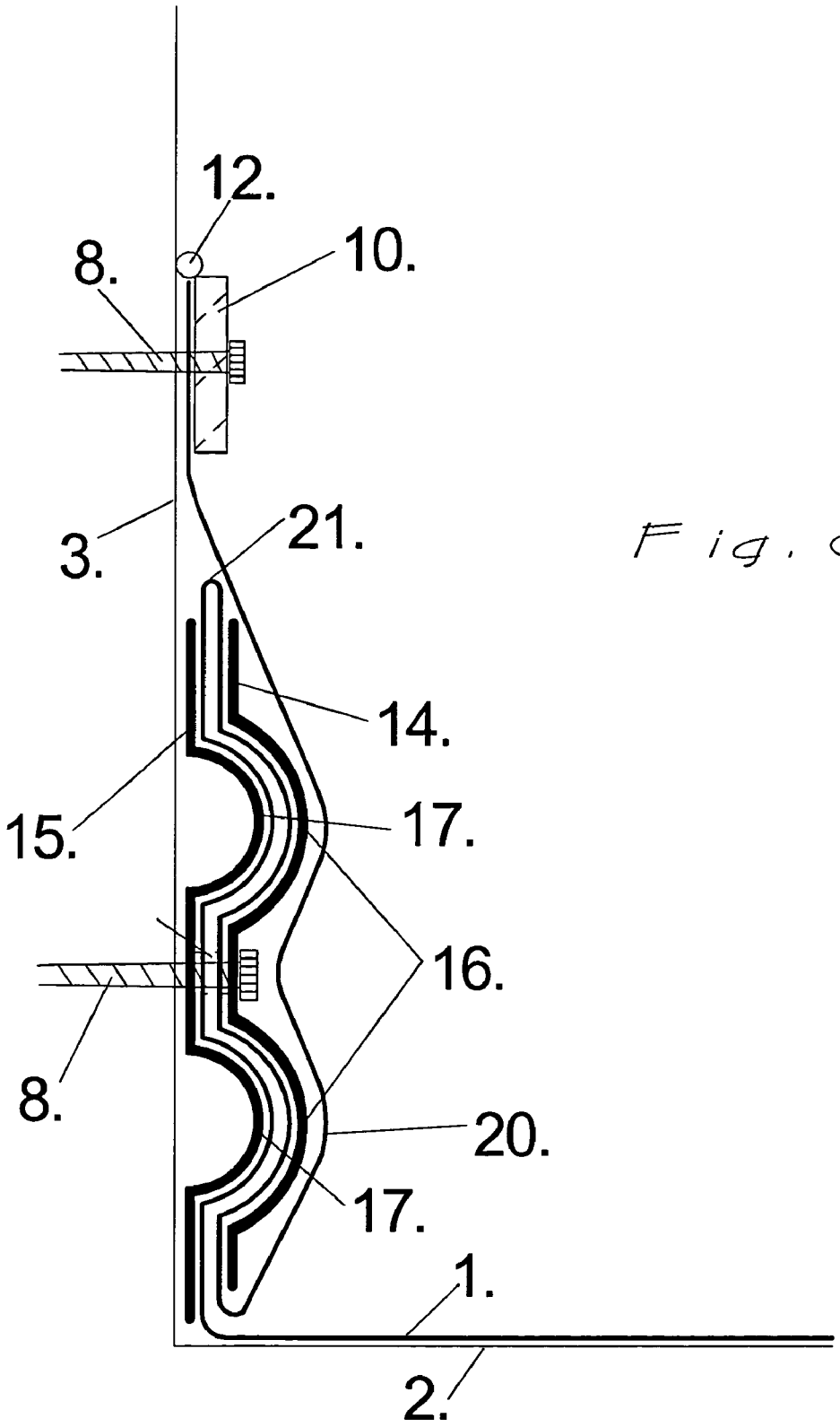
FIG. 6 is a side cutout view of the first device (5) that is described showing the device (5) in use. The device (5) is mounted on the wall (3) which extends above the level of the roof substrate (2) with the folded portion of the membrane (21) placed between the upper plate (14) and the lower plate (15) and secured by use of a mechanical fastener (8) passing through the folded portion of the membrane (21) as well as both plates (14 and 15) by use of the fastening points (13). The ridges (16) on the upper plate (14) cooperate with the ridges (17) on the lower plate (15). The excess membrane (20) is folded up and onto the wall (3) at a point higher than the vertical level of the device (5), whereby it is terminated by use of termination bar (10) fastened with a mechanical fastener (11) and sealant (12) at the upper point of the termination bar (10).
Figure 7:
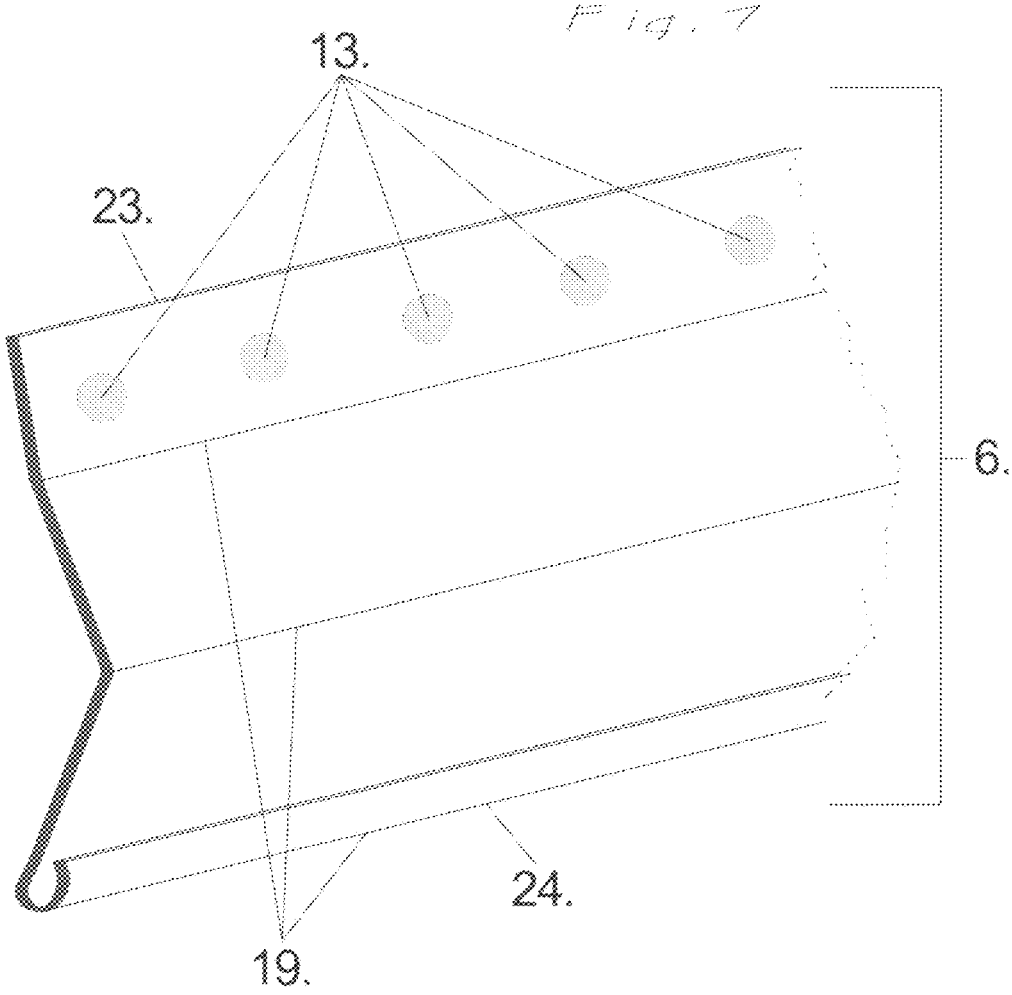
FIG. 7 is an isometric view in very simplistic form of the second device (6) that is described. The fastening points (13) and the multiple bends (19) in the body of the device (6) are depicted. The top portion (23) and the bottom portion (24) are indicated. The curl in the device (6) at the bottommost portion (24) is curved.
Figure 8:
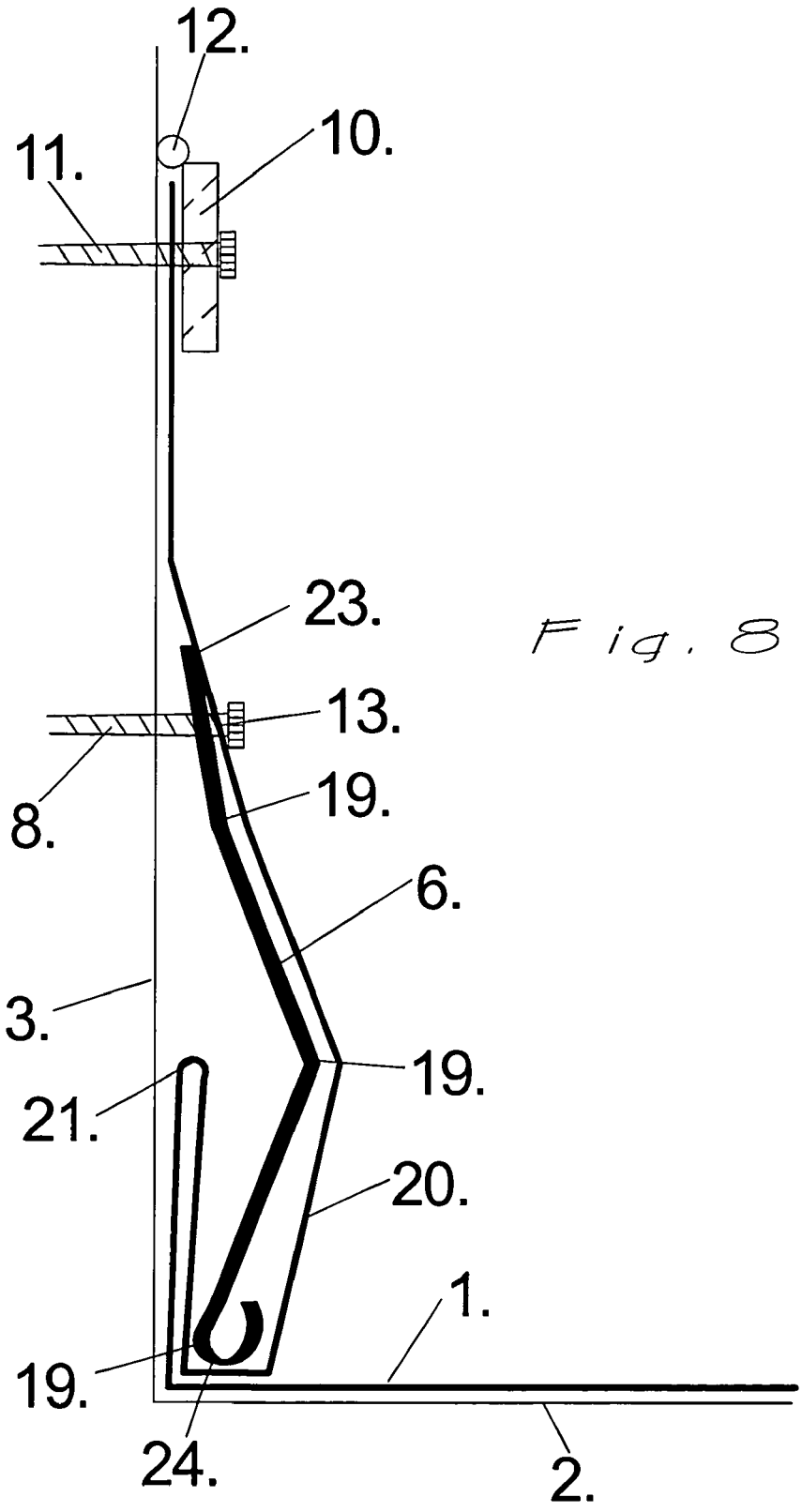
FIG. 8 is a side cutout view of a non-penetrative use of the second device (6 and as described in FIG. 7). The device (6) is mounted on the wall (3) which extends above the level of the roof substrate (2) with the folded portion of the membrane (21) placed beneath the device's (6) lower end (24) and secured by use of a mechanical fastener (8) passing through a fastening point (13) near the upper end (23) of the device (6). The multiple bends (19) in the device (6) enable compression of the folded portion of the membrane (21). The excess membrane (20) is folded up and onto the wall (3) at a point higher than the vertical level of the device (6), whereby it is terminated by use of termination bar (10) fastened with a mechanical fastener (11) and sealant (12) at the upper point of the termination bar (10).
Figure 9:
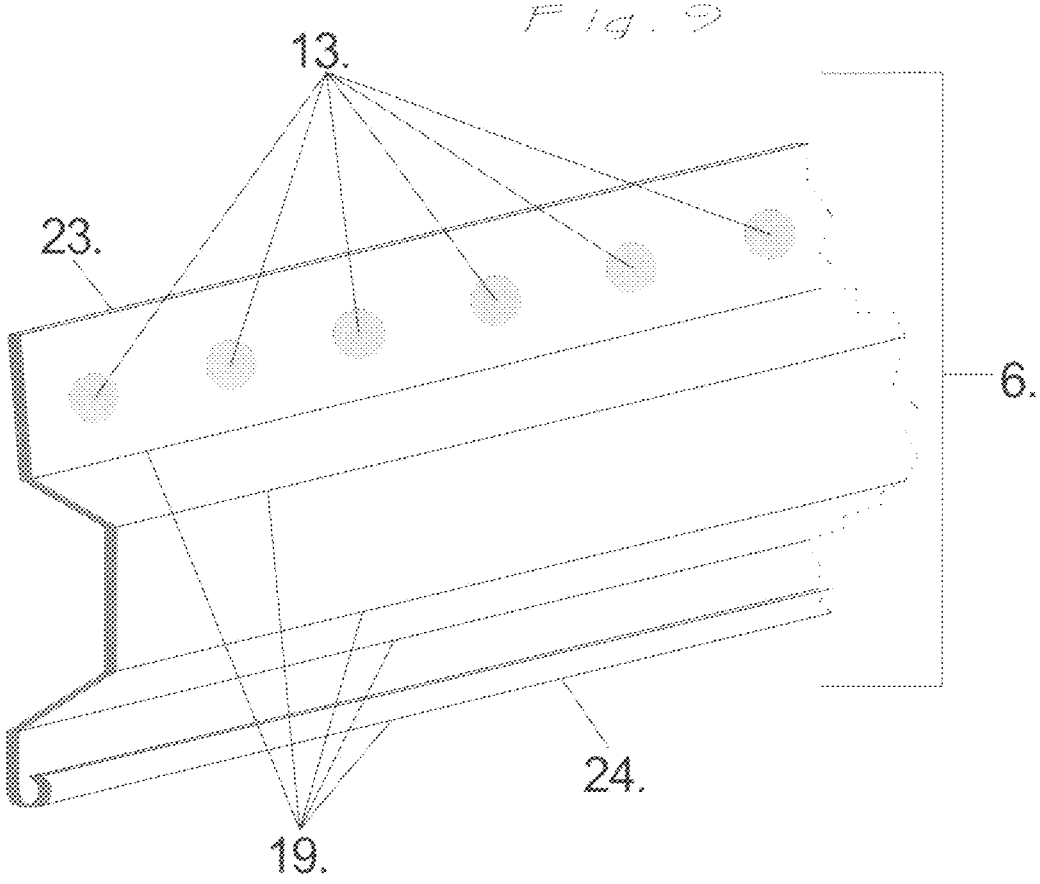
FIG. 9 is an isometric view of an alternate embodiment of the second device (6) that is described. The fastening points (13) and the multiple bends (19) in the body of the device (6) are depicted. The top portion (23) and the bottom portion (24) are indicated. The bend in the device (6) at the bottommost portion (24) is curved.
Figure 10:
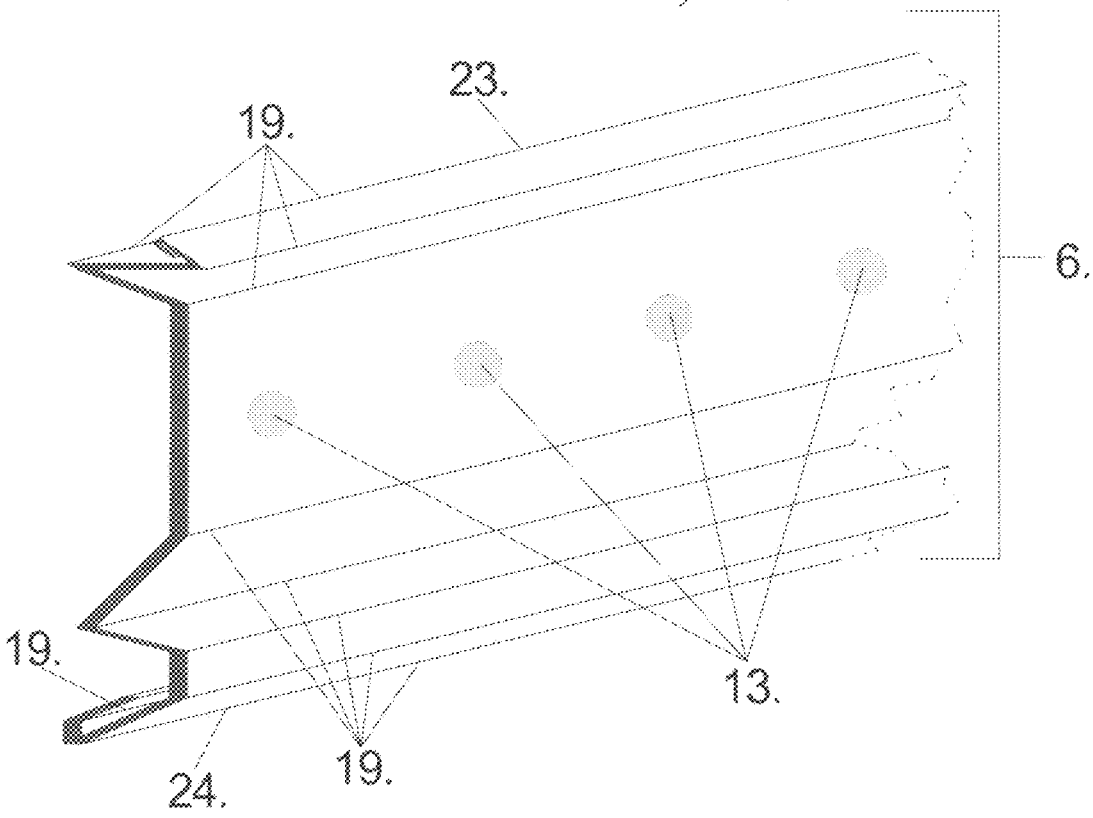
FIG. 10 is an isometric view of an alternate and more complicated embodiment of the second device (6) that is described. The fastening points (13) and the multiple bends (19) in the body of the device (6) are depicted. The top portion (23) and the bottom portion (24) are indicated.

The primary purpose of this invention is to create a superior waterproofing system for use with membrane roofing material for flat and low slope roofing situations. This purpose is achieved through use of a particular method coupled with devices that are designed specifically to hold a folded piece of membrane to a roof deck or vertical juncture. There are the following devices to be described and then a discussion will be made on the method of installation following and incorporated into a detailed description of each device.

When referring to the folded portion of the membrane, it is intended to describe that part of the membrane at the very perimeter of the building which is laid flat on the roof then folded back over such that the upper surface of the membrane is put into contact with itself and the lower surface of the membrane is exposed. The folded portion of the membrane describes the point of folding and a subsequent portion thereof where the parts of the membrane are in contact.

The first device (#5 when referring to its entirety in the drawings and depicted in FIGS. 1A through 6) is similar in some ways to the standard plate used to secure membrane to the deck of a roof. However, it differs in several key features. The invention hereby disclosed as the first device is of two separate objects, both in the basic form of either a circular or a polygonal shape with minimal height. It would ideally be fabricated from a fairly rigid material.

Within the interior of the body of the upper plate, there are one or more raised ridge(s) conforming to the same shape of the outer perimeter's shape and proportions, though of a smaller size. The shape of the ridge(s) is closed such that it is continuous and such that there is no beginning or ending point. In the interior of all ridges on the plate and preferably centered on at least one axis, there is a hole extending through the entirety of the plate through which a fastener can be placed during installation. There may be one or more of such holes depending on current needs.

The body of the lower plate is of slightly smaller proportions than the upper plate such that the underside of the upper plate conforms to the top side of the lower plate with clearance for the folded portion of the membrane to be placed between the two surfaces. It incorporates the same features as the upper plate, including one or more fastening hole(s) located at point(s) such that when the upper plate is placed on top of the lower plate, the fastening point(s) are both at the same locations relative to an axis set perpendicular through the center of said fastening point(s).

The purpose of the upper and lower proportionally sized plates is that the folded membrane can be placed between them and, upon placing appropriate fastener(s) through the fastening point(s), the membrane is compressed. By this compression, the membrane cannot move in any direction, thus held securely in place both by the fastener(s) and the friction between the upper and lower plates and the folded portion of the membrane. The ridges on both the upper and lower plates serve not only to further increase the amount of friction and holding power but also to prevent the movement of water between the interior surfaces of the folded layers of the membrane and to also prevent water from reaching the fastener. It is also possible to incorporate a raised semi-conical surface raised on an axis perpendicular to and centered around the fastening point(s) with the fastening point(s) at the highest point of the raised conical surface.

Once the membrane has been installed over the interior portions of the roof, it will have to be terminated and flashed at the perimeters in order to properly waterproof these locations. The lower plate of the first device will lie beneath the folded portion of the membrane and may or may not be fastened to the substrate depending on whether there is one or more fastening points. If there is only one fastening point, the lower plate will lay loose until the upper plate is fastened, whereby the fastener will pass through both the upper and lower plates, securing both plates as well as the membrane. If there is more than one fastening point, the lower plate can be fastened first to the substrate by passing a fastener through any one or more of the fastening points. Then, one would follow by placing the folded portion of the membrane on the top surface of the lower plate and placing the upper plate on the topside of the folded portion of the membrane, whereas the lower surface of the upper plate is in contact with the folded portion of the membrane. At this point, one would place one or more fastener(s) through the fastening point(s) of the upper plate, the folded portion of the membrane, the fastening point(s) of the lower plate, and through to the substrate, thus securing the compressed plates and folded membrane to the substrate or wall.

Once the folded portion of the membrane has been secured, the purpose of the next step is to waterproof the locations where the fastening and penetration of the membrane has occurred. There exists a single layer of excess membrane extending past the location of the device and generally located toward the direction of the roof's interior. This excess membrane is then folded away from the main roof and terminated by standard means (typically by securing with termination bar and placing a bead of sealant across the surface) either up a vertical wall which extends up above the level of the roof or down a vertical wall below the level of the roof. This process seals in the device in an envelope of membrane, thus protecting it from the elements. One would use a plurality of the devices with the actual quantity and spacing dependant on many factors including, but not limited to, the size of the building, wind uplift resistance requirements, and type and thickness of the membrane being used.

The second device (#6 when referring to its entirety in the drawings and depicted in FIGS. 7 through 10) is designed to be used as a pinching mechanism in either deck or wall mount situations with the membrane folded and fastened, followed with the excess membrane folded up and over the device to then be terminated by standard means. The device is, however, of a single nature, being made of only one part. It is fabricated from a rigid material, yet must also have ductile strength so as to be capable of bending, though, due to the rigidity, the ability to bend must be limited and only under extreme pressure. The strength in the device's nature is in its ability to compress and, therefore, it must be ductile, yet strong.

The overall shape of the pinching device is that of a flat piece of material into which multiple bends, all along the same axis, have been made. The piece of material can be a long and continuous piece, such that the height is a very small fraction of the overall length, or it can be of a size whereby the height and width are nearly equal. Ideally, one would envision a length convenient to transport yet long enough to minimize seams between pieces. It is possible, though not recommended, for the measurement of the length to be less than or equal to the measurement of the height if one desired many smaller pieces to be spaced some distance apart from each other linearly at the roof/wall juncture. There are a plurality of bends with the purpose of all bends together to provide compression at both the top end and the bottom end of the device towards and into, though not penetrating, the folded portion of the membrane at the bottom end of the device and the wall or substrate. The bends create a shape whereby when the device makes contact with the substrate or wall with the top end, then the device's body goes back out in the opposite direction of the substrate or wall and then back again towards the direction of the substrate or wall and makes contact once more with the bottom end. The bottom end can be fabricated as curved. This will prevent the material from penetrating the membrane where it folds up onto the wall. The bends may be made in many variations such that the same purpose is achieved and the process of the device's body being made to recede away from the membrane and then back may occur more than a single time. The device also consists of a single fastening point or a plurality of fastening points that are located at the topmost portion of the device such that the first unbent portion will be pressed firm against the substrate or wall at the point at which it is fastened. It would follow then, that the lowest portion of the device would compress the folded portion of the membrane at the point(s) where the membrane and the device come into contact.

The usage of this pinching device as described above would be very similar to the plate device described in the previous paragraphs. The membrane would be fastened to the main interior portions of the roof. At the juncture of the edge of the roof and the wall (can be used to fasten on walls either rising above the surface of the roof or below the surface of the roof), the membrane would be folded back towards the direction of the interior of the roof. Then, the device would be attached to either the substrate or the wall via mechanical fastener(s) through the fastening point(s). The number of fasteners would be dependant on many factors including, but not limited to, the size of the roof, wind uplift resistance requirements, and the type and size of membrane being used. Once the device is fastened, the excess membrane would then be folded up over the device and terminated on the wall, above the height level of the device, by standard termination means as previously described. One could either use a plurality of shorter length devices with distances between them or a minimal number of longer pieces with seams overlapping.

Figure 11:
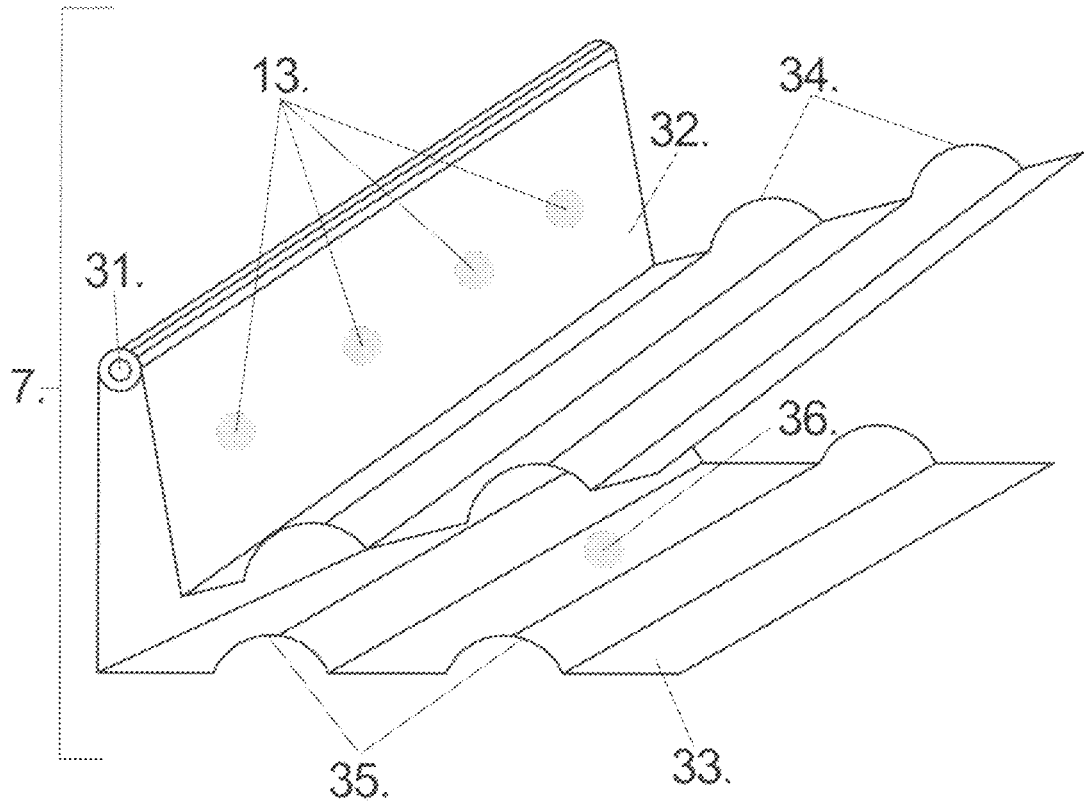
FIG. 11 is an isometric view of the third device (7) that is described, embodied as a single piece device. It depicts the fastening points (13), the hinge device (31), the ridges (34) on the upper section (32), the ridges (35) on the lower section (33), and the possible fastening point (36) on the lower section (33).
Figure 12:
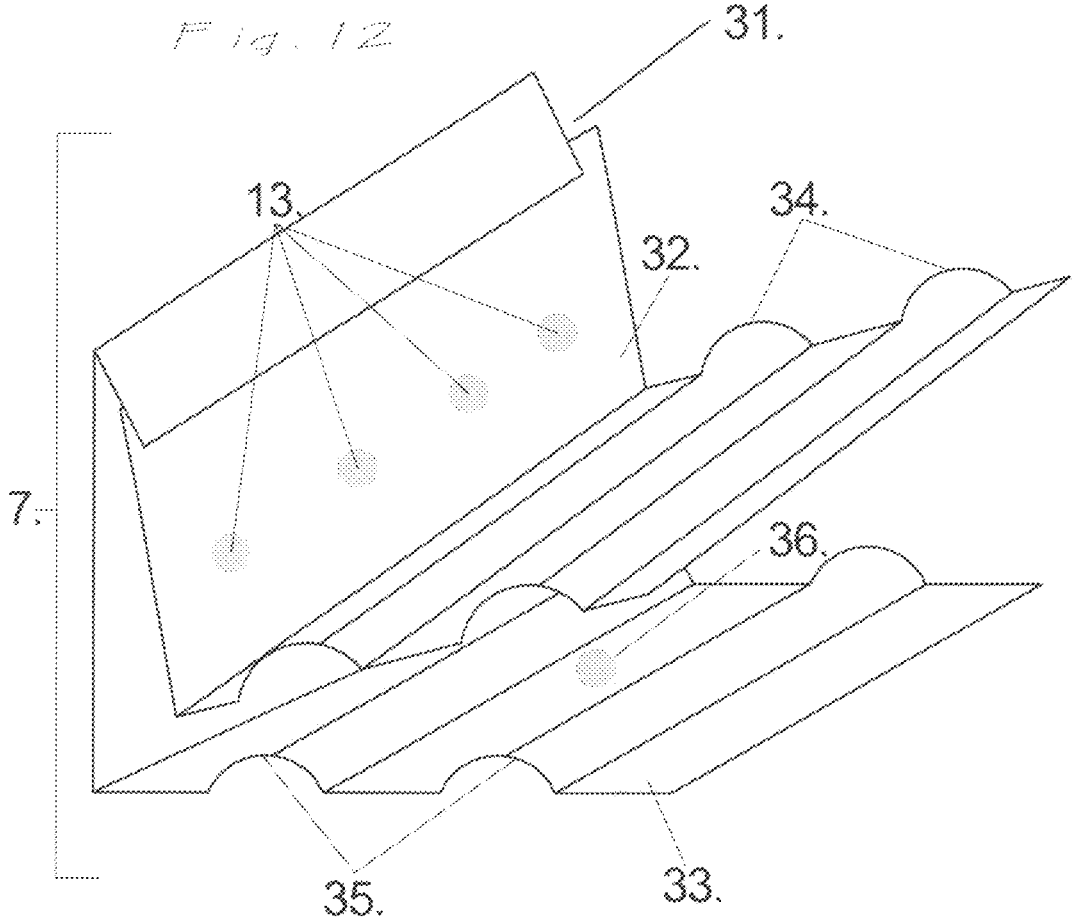
FIG. 12 is an isometric view of the third device (7) that is described, embodied alternately as a two piece device. It depicts the fastening points (13), the hinge device (31), the ridges (34) on the upper section (32), the ridges (35) on the lower section (33), and the possible fastening point (36) on the lower section (33).
Figure 13:
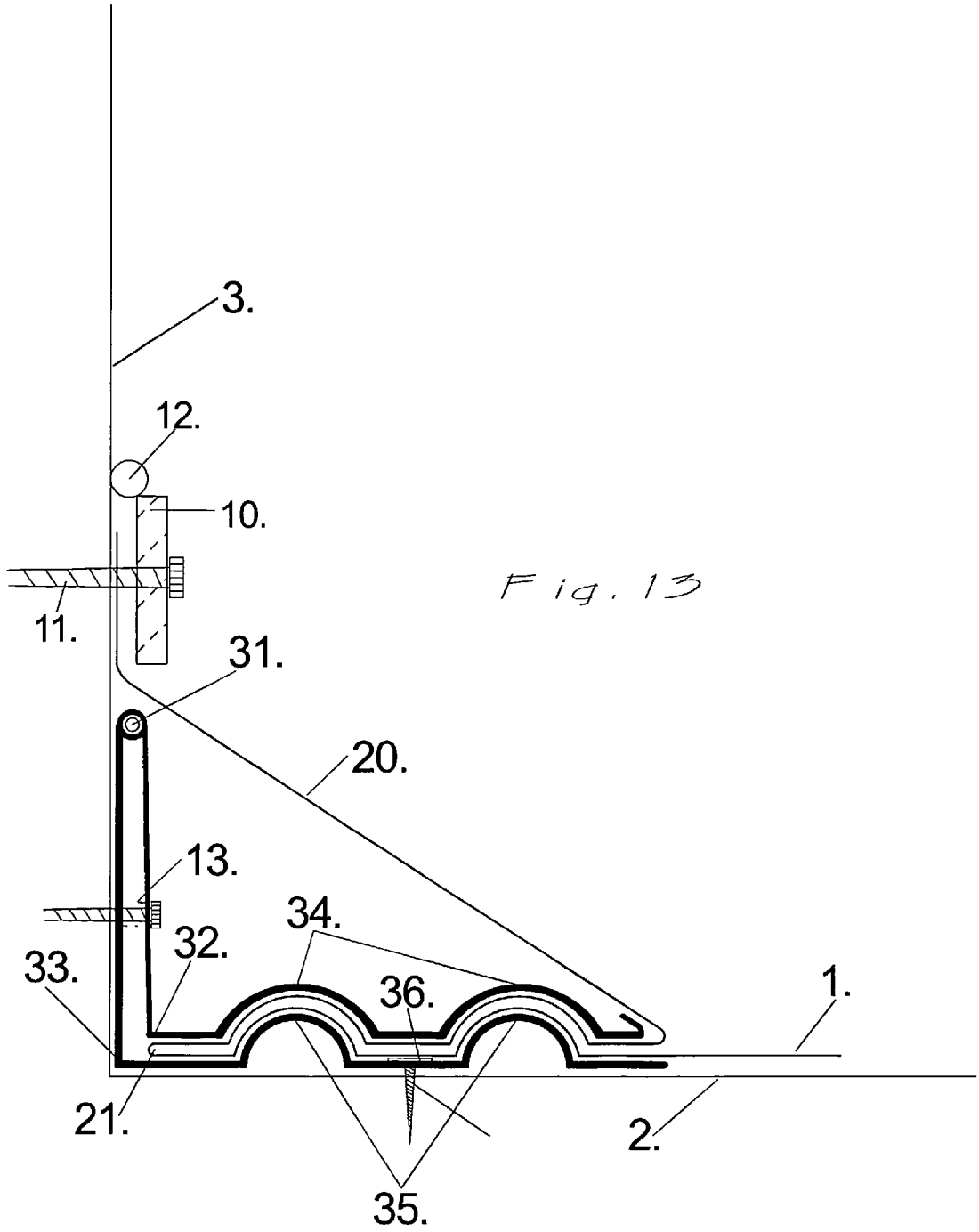
FIG. 13 is a side cutout view of the third device (7) that is described, depicting it in one possible embodiment mounted at the roof substrate (2) and wall (3) juncture. A fastener (8) can, though not necessary, be placed through the optional fastening point (36) and through to the substrate (2). The folded portion of membrane (21) is placed between the upper section (32) and the lower section (33) of the device (7). Another fastener (8) is placed through the fastening point (13), thus compressing the folded portion of the membrane (21). The ridges (34) on the upper section (32) and the ridges (35) on the lower section (33) help to compress the folded portion of the membrane (21) and prevent any pull from the area of the main roof's membrane (1). The excess membrane (20) is folded up and onto the wall (3) at a point higher than the vertical level of the device (6), whereby it is terminated by use of termination bar (10) fastened with a mechanical fastener (11) and sealant (12) at the upper point of the termination bar (10).

The third device (#7 when referring to its entirety in the drawings and depicted in FIGS. 11 through 13) to be described is designed to also have a gripping force on the membrane, though it incorporates a hinge-like mechanism to achieve this. The device can be embodied as either a two piece design or a single piece design. It is designed to be installed on the very edge of the roof, at the juncture between the roof and the upper wall and to use similar fastening methods as described previously. It is desired that the fabricated device should be of a material that is very rigid.

The device itself can have multiple designs, though centered around a single piece embodiment and a dual piece embodiment. The preferred embodiment of a singular piece design is described firstly. The device is comprised of essentially two pieces joined together by a hinge-like device which not only serves to hold the two pieces together into a single piece, but also serves to allow rotational movement about the axis whereas the two pieces are joined. It is also possible to make the same device but in a two piece design, whereas the upper and lower sections are separate but can be placed together in a non-permanent fashion in order to act as a hinge and, upon fastening, will act as a single piece device with a hinge.

The design of the upper and lower pieces of the device is of a piece of material that has been bent into an angle near that of a right angle (minimal variation in the direction of obtuseness is possible though the angle should not be acute in nature). Into the bottom section of the angled material of the lower piece of the device, there would be either one or a multiplicity of raised ridges. Into the bottom section of the angled material of the upper piece of the device, there would be the same number and type of raised surfaces, though they would be of either the same size or larger than those ridges of the lower piece, such that the upper piece and the lower piece would cooperate. The upper section of the both the upper and lower pieces of the device would ideally be flat, though their shape would not be of issue, so long as the upper and lower pieces cooperate with each other and conform to some degree to the wall to which they will be attached. The device in its entirety would be generally of an "L" shape with a hinge device at the very topmost extent of the "L." It could be constructed in a fashion whereby the device is taller than it is wide or it could be designed as a very long piece.

Into the upper section of both the upper and lower pieces of the device, there would be a fastening point such that a mechanical fastener could extend through the upper piece, the lower piece and then into the wall. There can be one single fastening point on a device of very short length or there could be a plurality of fastening points on a device of longer length. It is also possible to have a fastening point on the lower piece of the device such that it could be fastened prior to the mechanical fastener being placed through both the upper piece and the lower piece.

The method of installation for the hinge device is quite similar to that of the previously described devices but would differ in details. The device would be situated such that it conforms to the angle between a wall extending above the level of a roof. If there is a fastening point present in the lower piece of the device, one would first place a fastener through said fastening point, thus anchoring the lower piece of the device to the substrate of the roof. If no fastening point is present on the lower piece of the device, then one would lay the device loosely at the point where the wall and roof substrate meet. The membrane would first be fastened on the interior portions of the roof then at the wall/roof juncture, the membrane would be folded such that the endpoint of the membrane reached in the same direction of the interior of the roof. The folded portion of the membrane would then be placed between the upper piece and the lower piece of the device. One would then place a fastener through the fastening points of the upper piece and the lower piece such that it extended into the wall, thereby compressing the membrane and holding it secure in a non-penetrative fashion between the lower sections of the upper piece and lower piece of the device.

It is also possible to place the folded portion of the membrane such that it lies between the upper piece and lower piece of the device and the fastener penetrates the membrane, thus holding it even more secure. This procedure would be optional and would not change the function of the entire system in any significant way.

Once the folded portion of the membrane has been secured and the device has been properly fastened, there exists an excess single layer of membrane that remains unsecured. This layer of membrane will then be folded up towards the uppermost portion of the wall and terminated by standard methods.

It is possible for all of the devices that have been previously described to also be suited for a situation where there is no vertical wall rising above the level of the roof. In the situation of a roof that ends without said wall, one could employ the abovementioned devices by attaching them to that part of the wall which extends below the level of the roof. In some cases, one may be required to mount them upside down from how they were previously described. Any such person who is skilled in the art will find multiple methods and adaptations for these methods and devices though all center around a central basic idea.

The previous paragraphs have detailed the invention and how it applies to the perimeters of a roof but there must be mention made as to how rectangular roof penetrations (which must also be flashed) are handled. The typical roof penetration would be treated as a wall that extends up above the surface of a roof and the devices, as previously described, would be fastened accordingly with the membrane also folded up and over the device, then terminated by standard means up the wall of the curb. The corners of the penetration could be flashed by standard means (typically with preformed corners made of a material that is compatible with the membrane), ensuring that the folded portion of the membrane is welded together so as to seal in the fasteners and also to prevent water from penetrating and reaching the underside of the membrane. Round roof penetrations (i.e. pipes, etc.) could also be handled by standard methods.

It is the intention of the inventor to introduce these devices and method in order that the practitioner of the roofing art will be able to utilize them accordingly and still be capable of adapting them to each job. With the wide variations in today's buildings, it is necessary to be able to change while still maintaining the spirit of the invention.

What is claimed is:

1. A method of waterproofing and flashing a vertical juncture of a roof having an interior portion with a roof substrate for attaching a membrane and a perimeter, wherein the vertical juncture includes walls above the level of the roof, or walls below the level of the roof, or a penetration curb, including the steps of:

providing a membrane;

installing the membrane over the interior portion of the roof;

folding the membrane at the vertical juncture, whereby the membrane from the roof is folded back and onto an upper surface of the membrane providing a folded portion of the membrane with the upper surface of the membrane in contact with the folded portion of the membrane, and an excess portion of the membrane extending from the folded portion;

securing the folded portion of the membrane to either the roof or the vertical juncture;

folding the excess portion of the membrane in such a manner as to cover a section of a roof seam, a juncture, or an edge and the folded portion of the membrane that is secured to the roof or the vertical juncture;

folding the excess portion of the membrane in a next step to seal in an envelope of membrane where the membrane has been previously secured to either the roof or the vertical juncture; and terminating the excess portion of the membrane to either the roof or the vertical juncture.

2. A method of waterproofing and flashing the vertical juncture of the roof as stated in claim 1 in which:

the step of securing the folded portion of the membrane includes placing an upper plate in contact with the folded portion of the membrane and securing the upper plate to a lower plate and securing the upper and lower plates as compressed plates to a substrate.

3. A method of waterproofing and flashing the vertical juncture of the roof as stated in claim 2 in which:

the step of terminating the loose excess portion of the membrane to either the roof or the vertical juncture includes attaching a termination bar to the roof or the vertical juncture and placing a bead of sealant on the surface of the termination bar.

4. The method of waterproofing and flashing a vertical juncture of a roof of claim 1 whereby: the step of securing the folded portion of the membrane to either the roof or vertical juncture comprises anchoring the folded portion of the membrane with a single piece of anchor material, said anchor material having a front surface and a back surface and at least two bends, wherein when a pressure is exerted on the front surface of the anchor material, all of the pressure is transferred to the vertices of the bends on the back surface, which make contact with the membrane and serve to anchor said membrane to the roof or vertical juncture; wherein the anchor material has at least one hole formed which passes through the top of both the front and back surfaces, wherein a fastener can be passed through said at least one hole with a fastening end going first through the front surface then through the back surface of the anchor material to fasten said anchor material to the roof or vertical juncture; wherein each of said at least one hole is set high enough on the anchor material so that there is room above said hole for the folded portion of the membrane to make contact with at least one bend of the anchor material while not obstructing the hole; wherein each of said at least one hole is set the same distance from the top of the anchor material, and wherein when the anchor material is fastened to the roof or vertical juncture with the fastener, pressure of the fastener on the front surface is transferred to the vertices of the needs on the back surface which make contact with the folded portion of the membrane, thus anchoring the membrane to the roof.

5. The method of waterproofing and flashing a vertical juncture of a roof of claim 1 whereby: the step of securing the folded portion of the membrane to either the roof or vertical juncture comprises anchoring the folded portion of the membrane with a two piece anchor device, wherein said anchor device comprises an upper piece and a lower piece, wherein each upper and lower piece is a formed into an angle of at least ninety degrees or more; wherein each piece of the device has a top surface and a bottom surface as well as a top end and a bottom end; wherein the bottom surface of the upper piece opposes the top surface of the lower piece of the anchor device, wherein the upper and lower pieces of the anchor device are hinged together connecting top ends of both pieces of the device such that the pieces pivot around their top ends; wherein there exists at least one raised ridge in the top surfaces of each upper and lower pieces of the device that are substantially similar shape and size, so that the upper and lower pieces of the device cooperate when pressed together; wherein there exists at least one hole in each of the upper and lower pieces, wherein the at least one holes of each the upper and lower pieces cooperate to form a through passage in which a fastener can be placed, extending a fastening end first through the top surface of the upper piece of the device and towards the roof or vertical juncture, securely fastening it in place; wherein when the folded portion of the membrane is placed between the upper and lower pieces, and upon placement of said fastener through both of the at least one holes in the upper and lower pieces, said hinged connection aids in compressing the membrane and holding it in place.

* * * * *